US005193317A

United States Patent [19]

Nordquist et al.

[11] Patent Number: 5,193,317

[45] Date of Patent: Mar. 16, 1993

[54] METHOD FOR GRINDING METAL AND METAL-ALLOY STOCK

[75] Inventors: Tom Nordquist, Bågvägen 7, Västervik, Sweden, S-593 41; Leo Malinen, Degerfors, Sweden

[73] Assignee: Tom Nordquist, Sweden

[21] Appl. No.: 659,399

[22] PCT Filed: Sep. 14, 1989

[86] PCT No.: PCT/SE89/00496

§ 371 Date: Apr. 12, 1991

§ 102(e) Date: Apr. 12, 1991

[87] PCT Pub. No.: WO90/02631

PCT Pub. Date: Mar. 22, 1990

[30] Foreign Application Priority Data

Sep. 16, 1988 [SE] Sweden ..... 8803281

[51] Int. Cl.[5] ..... B24B 21/08

[52] U.S. Cl. ..... 51/322; 51/141; 51/137; 51/148

[58] Field of Search ..... 51/322, 137, 138, 135 R, 51/141, 148, 357, 166.75, 165.73, 394, 400, 407

[56] References Cited

U.S. PATENT DOCUMENTS

| | | | |
|---|---|---|---|
| 1,689,512 | 10/1928 | Worton . | |
| 3,654,739 | 4/1972 | Stoy | 51/148 |
| 3,774,353 | 11/1973 | Yasunaga | 51/322 |
| 3,833,346 | 9/1974 | Wirth | 51/307 |
| 4,262,455 | 4/1981 | Rettew . | |
| 4,601,134 | 7/1986 | Hessemann | 51/138 |
| 4,862,570 | 9/1989 | Bald et al. . | |
| 4,871,376 | 10/1989 | DeWald | 51/298 |

FOREIGN PATENT DOCUMENTS

| | | |
|---|---|---|
| 1752264 | 12/1971 | Fed. Rep. of Germany . |
| 3031877 | 1/1982 | Fed. Rep. of Germany . |
| 3037571 | 4/1982 | Fed. Rep. of Germany . |
| 3600144 | 7/1987 | Fed. Rep. of Germany . |
| 1232226 | 5/1971 | United Kingdom . |
| 2084494 | 4/1982 | United Kingdom . |

OTHER PUBLICATIONS

The New American Machinist's Handbook Chapter 5, p. 48 New Hot Grinding and Cut Off Systems.

Stahl and Eisen 92 (1972) Nr. 18, pp. 899–900, Patentverkets Bibliotek Sektion I/Katalogrum.

*Primary Examiner*—Bruce M. Kisliuk

*Assistant Examiner*—Eileen P. Morgan

*Attorney, Agent, or Firm*—Lerner, David, Littenberg, Krumholz & Mentlik

[57] ABSTRACT

Methods for treating surface faults and impurities on metal stock which has been subjected to hot working are disclosed in which the hot metal stock is subjected to grinding from an endless abrasive belt while the hot metal stock from the hot working step remains at a temperature of between about 500° and 1500° C., and the desired grinding pressure is applied to the hot metal stock during the grinding step by means of a contact device in which the applied pressure is created by a fluid so that the contact device remains in floating contact with the hot metal stock during grinding. Apparatus for treating surface faults and impurities on such hot metal stock are also disclosed.

31 Claims, 4 Drawing Sheets

METHOD FOR GRINDING METAL AND METAL-ALLOY STOCK

FIELD OF THE INVENTION

The present invention relates to a method of grinding metal and metal-alloy billets, stock or like workpieces, hereinafter referred to generally as stock, wherein surface faults and surface impurities are removed and/or exposed while the stock is hot and before scale and oxide layers are able to form, and which may not be readily machined or worked.

BACKGROUND OF THE INVENTION

Metal and metal-alloy stocks are ground primarily in order to disclose the possible presence of surface cracks or fissures and slag/inclusions, so that the stock can be worked locally and brought to a satisfactory state prior to being rolled. The stock or billet is thus ground to remove a surface layer which contains slag and like impurities which rise to the surface as the stock is cast. When cold stock is ground, the stock will invariably be coated with a heavy oxide-containing layer that forms as the stock cools. This layer therefore has to be removed together with the aforesaid slag inclusions.

When working or machining in accordance with known methods stock which is, e.g. to be subsequently rolled in a rolling mill, coarse grinding disks are often used and the stock is ground in strip-like patterns along a plurality of narrow, mutually parallel channels, which results in low grinding capacity. Furthermore, this grinding procedure leaves a rough and rippled surface, and the stock cannot be ground until the temperature thereof has fallen to a level at which the grinding disk will not explode. Because of the relatively long time taken to complete this grinding procedure, the stock will cool to a still lower temperature. Consequently, during this cooling period there is formed a relatively thick layer of oxides and scale, which cannot be machined readily and which can only be ground away with great difficulty and with high energy inputs. It is also necessary to grind through the layer, therewith removing excessive quantities of valuable underlying material.

Furthermore, the abrasive tool used is subjected to pronounced wear, which further impairs the economy of conventional methods which use grinding disks, grinding rolls or like abrasive tools.

One example of the presently known techniques is found in DE-OS 3 600 144 published on the 9th July 1987. This publication describes a method for the removal of scale with the aid of two mutually opposing grinding rolls. This publication reveals that those skilled in this art consider grinding with an abrasive belt to give a poor grinding result, due to the difficulty of applying the high grinding pressure required to remove the scale and the oxide layer formed on the rolled stock as it cools.

The known methods are thus encumbered with a large number of drawbacks. These drawbacks are avoided by the present invention, which relates to a method for grinding metal or metal-alloy stock, billets and like workpieces in a hot state, by means of grinding with an abrasive belt in accordance with the disclosure which follows.

SUMMARY OF THE INVENTION

In accordance with the present invention, these and other objects have now been accomplished by means of a method for treating surface faults and impurities on metal stock which has been subjected to hot working which comprises grinding the metal stock by applying an endless abrasive belt to the hot metal stock while the hot metal stock from the hot working remains at a temperature of between about 500° and 1500° C., preferably between about 700° and 1200° C., and most preferably between about 800° C. and 1100° C., and applying the desired grinding pressure to the hot metal stock during the grinding by means of a contact device in which the pressure applied by the contact device is created by a fluid, whereby the contact device maintains floating contact with the hot metal stock during the grinding.

In accordance with one embodiment of the method of the present invention, the endless abrasive belt comprises a backing material coated with abrasive particles, the backing material preferably being polyester or cotton, and the particles preferably being zircon-corundum or corundum. In a preferred embodiment the abrasive particles have a particle size in the range of between about 12 and 100 mesh, preferably between about 20 and 60 mesh, and most preferably between about 24 and 60 mesh.

In accordance with another embodiment of the method of the present invention, the grinding comprises applying the endless abrasive belt to the hot metal stock with the endless abrasive belt travelling at a speed of between about 10 and 50 m/s, preferably between about 15 and 40 m/s, and most preferably between about 20 and 35 m/s.

In accordance with another embodiment of the method of the present invention, the pressure applied by the contact device is created by a piston-cylinder device. In another embodiment, grinding of the hot metal stock is conducted transversely to its longitudinal direction, and most preferably grinding comprises transversely applying the endless abrasive belt to at least half the radius of the longitudinal edges of the hot metal stock.

In accordance with another embodiment of the method of the present invention, apparatus for treating surface faults and impurities on metal stock which has been subjected to hot working has been discovered, comprising grinding means for grinding the hot metal stock, the grinding means including an endless abrasive belt for grinding the hot metal stock while the hot metal stock from the hot working remains at a temperature of between about 500° and 1500° C., preferably between about 700° and 1200° C., and most preferably between about 800° and 1100° C., and contact means for applying the desired grinding pressure to the hot metal stock during the grinding, the contact means including fluid activation means for maintaining floating contact with the hot metal stock by means of a fluid during the grinding.

In a preferred embodiment of the apparatus of the present invention, the endless abrasive belt includes belt guide means for guiding the endless abrasive belt about a continuous path, and drive means for driving the endless abrasive belt.

In accordance with another embodiment of the apparatus of the present invention, the fluid activation means comprises a piston-cylinder device operated by means of compressed air. In a preferred embodiment, the contact means comprises at least one pressure roller, while in another embodiment the contact means comprises a pressure plate for abutting the endless abrasive belt by means of an air cushion, and includes a pair of pressure rollers on opposite sides of the pressure plate, the pair of pressure rollers being loaded by means of fluid pressure.

In accordance with another embodiment of the apparatus of the present invention, the apparatus includes oscillating means for oscillating the contact means with respect to the hot metal stock. Preferably, the oscillating means comprises a hydraulic piston-cylinder device.

In another embodiment, cooling means are provided for supplying cooling air to the endless abrasive belt.

The present invention affords several advantages over the prior art techniques, a number of these advantages being given below.

Surface faults and surface impurities are removed and/or exposed, so that they can be ground separately, both quickly and in an energy-lean fashion.

Considerable energy savings are made, because the stock is ground before scale and an oxide layer forms, this scale and oxide layer being both hard and difficult to remove.

The formation of oxide and scale is reduced, so that the surface layer will be thinner and more readily removed.

Because the abrasive belt is flexible and presents a wide abutment surface to the stock, the stock surface facing the belt can be ground in one and the same grinding step, together with parts of the edges of the stock surface.

The grinding width of the belt can be varied, e.g. within a range of 10–1400 mm, preferably 150–900 mm (single-jointbelt), said width being adapted to the dimensions of the stock.

Grinding with the aid of an abrasive belt results in much smoother and much finer stock surfaces, which facilitates fault seeking and results in higher quality.

Less material is lost, since it is not necessary to grind away a thick oxide layer or such a large part of the underlying material, due to the reduced grinding depth.

Production is simpler and quicker.

When practicing the present invention, the stocks are ground while still hot, preferably in direct connection with casting, continuous casting, rolling or some other hot-working process, with the aid of an endless abrasive belt, wherein the requisite grinding pressure is obtained by means of a single contact device which is placed under fluid pressure.

Thus, the stock is worked within a temperature range in which resistance to deformation is low. It is known that working resistance decreases with increasing temperature and that the amount of energy consumed with each unit quantity worked also falls. This applies to both steel and other metals or metal alloys, and also to the oxides and slag substances formed. Consequently, significant savings in energy can be made when grinding is carried out at high temperatures.

When grinding steel stock at conventional temperatures, i.e. temperatures beneath 200° C., the efficiency is about 3 kg/kWh, while at temperatures of about 800–1000° C., the efficiency is about 8–10 kg/kWh.

Thus, it is possible to grind hot stock successfully in a temperature range whose lower limit is determined by the lowest temperature a which the temperature of the metal or metal alloy is still sufficiently high for scale and oxide-layers not to have formed, and where the upper limit is determined by the composition of the abrasive belt, i.e. the highest temperature at which the belt will not be affected detrimentally or destroyed by the heat radiating from the stock, it being necessary, in this regard, to take into account the speed at which the belt rotates.

Thus, when working or machining steel stock, a temperature range of 500–1500° C., preferably 700–1200° C., and particularly 800–1100° C. can be applied.

It has surprisingly been found that abrasive belts can readily be used for grinding stock whose temperature lies within the aforesaid temperature ranges. The abrasive belt comprises a substrate, e.g. a polyester or cotton fabric substrate, and abrasive particles or grains bonded to the substrate with the aid of an appropriate binder. Of those abrasive belts at present available there is preferably used belts which comprise zircon-corundum or corundum, although other materials may also be used. The grain size should lie in the range of 12–100, preferably 20–60, particularly 24–50 mesh (grain number according to FEPA). The best beltwear strength has hitherto been obtained with a grain size of 24–30 mesh. Polyester fabric is preferred as the substrate material, because polyester fabric is stronger than cotton fabric.

The belt speed should lie in the range of 10–50, preferably 15–40, particularly 20–35 m/s, so that the belt will be cooled sufficiently to prevent it from melting or being destroyed in some other way by the heat radiating from the stock to be ground. The belt speed is also determined by the desired efficiency, and should not be so low as to enable the stock to cool to a temperature at which the aforesaid advantages will no longer be attained.

Furthermore, in order to achieve a satisfactory grinding effect, the abrasive belt is placed under pressure in a manner to obtain the requisite grinding pressure. This is achieved by applying fluid pressure to the belt, whereby the grinding pressure will remain constant irrespective of the contours of the stock. This can be achieved, for instance, with the aid of a compressed-air device, such as a piston-cylinder device, a shell or bellows structure, or hydraulically, or with the aid of a spring device or by weight pressurizing.

BRIEF DESCRIPTION OF THE FIGURES

The invention will now be described in more detail with reference to a number of exemplifying embodiments thereof illustrated in the accompanying drawings, in which.

Like components are identified in the figures with like reference numerals.

DETAILED DESCRIPTION

Figure 1:
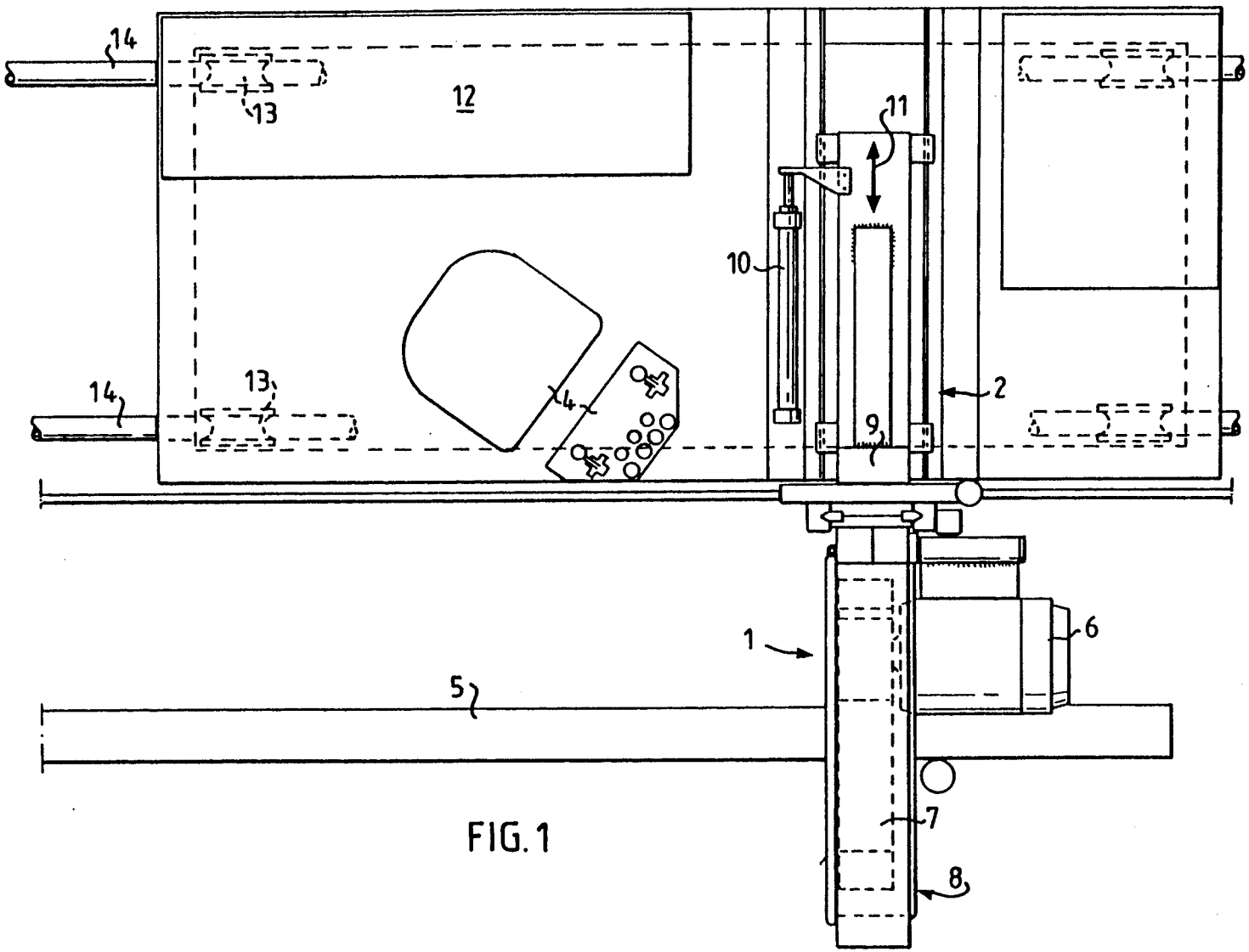
FIG. 1 is a plane view of apparatus for transverse-grinding of stocks comprising a grinding assembly suitable for carrying out the method according to the present invention.

Thus, FIG. 1 illustrates schematically apparatus for grinding stock arriving from a hot working plant, e.g. a rolling mill. Although the invention can be applied in various different fields, it will be described here with reference to the grinding of square-section stock arriving from a rolling mill and heated to the temperature prevailing in said mill, meaning in effect that the blanks will be red hot.

Figure 4:
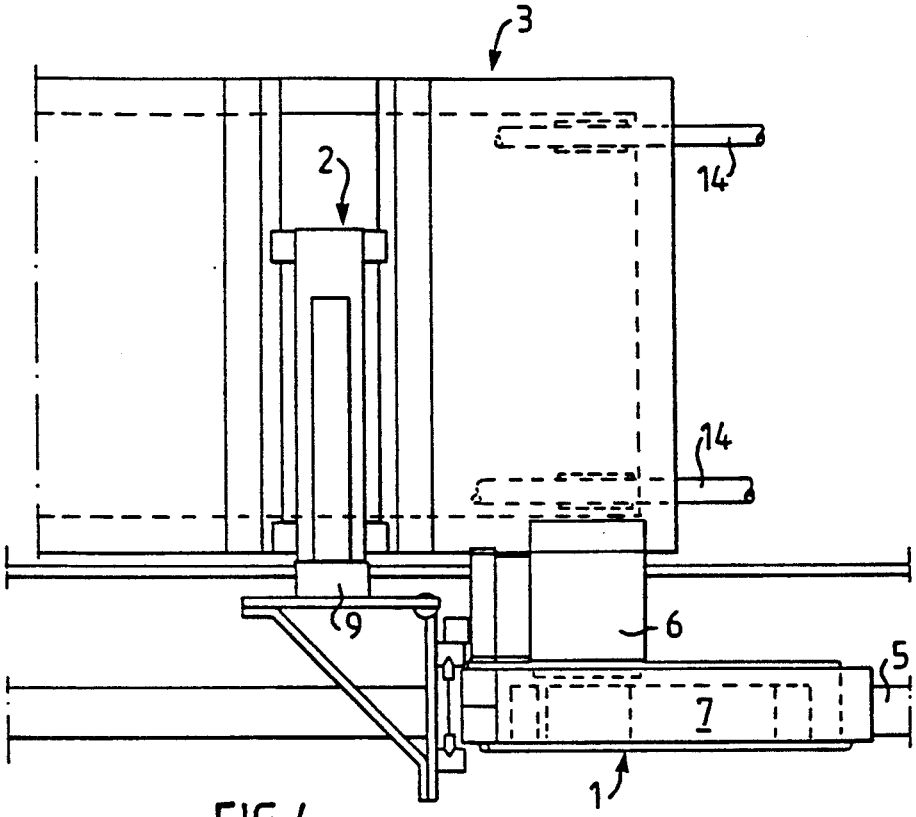
FIG. 4 is a plane view of apparatus for longitudinal-grinding of stock with the aid of an inventive grinding assembly.
Figure 6:
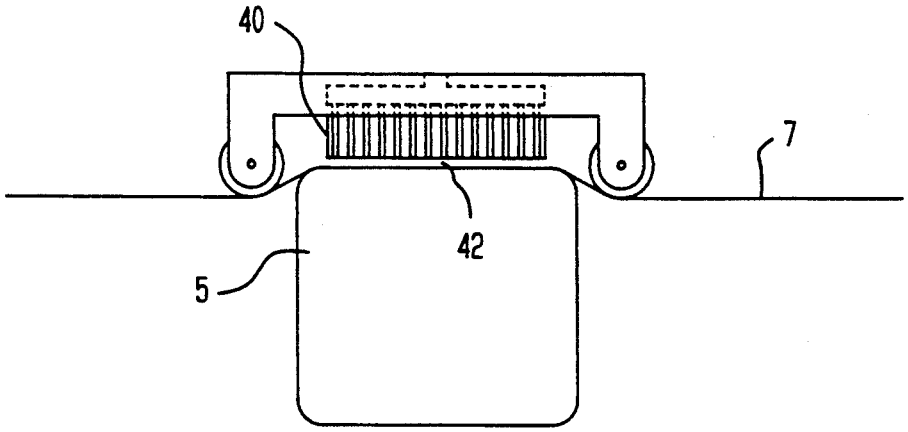
FIG. 6 is an enlarged end view of a selected portion of the apparatus shown in FIG. 5, illustrating the relationship between the pressure plate, the contact rollers, the air cushion, the endless abrasive belt, and the metal stock.
Figure 5:
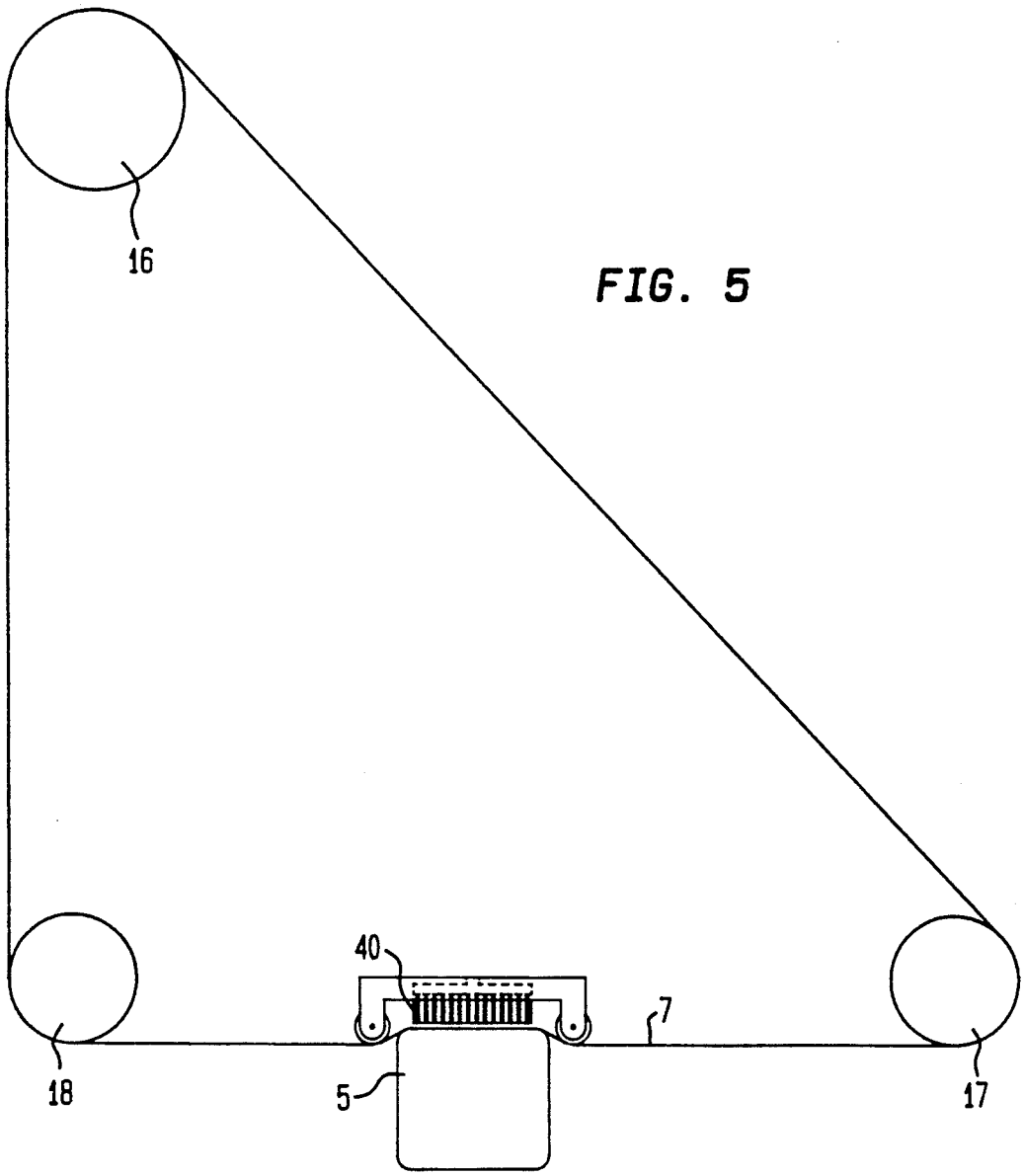
FIG. 5 is an end view of a second embodiment of an apparatus for transverse grinding of stocks comprising a grinding assembly suitable for carrying out the method of the present invention.

The illustrated apparatus includes a grinding assembly, a frame structure 2 on which the grinding assembly is mounted for vertical movement, and an operations unit 3 which may be mounted on a carriage or stationarily arranged and which also includes an operator's place 4. In the case of the embodiment illustrated in FIG. 1, the apparatus is intended for grinding stock 5 in a direction transversely to the direction of its longitudinal axis, whereas FIG. 4 illustrates apparatus intended or adapted for grinding stock in the direction of its longitudinal axis.

The grinding assembly 1 includes a drive motor 6, an endless abrasive belt 7, indicated in broken lines in FIG. 1, which runs in a belt-casing 8.

The frame structure 2 includes a frame part which is moveably mounted on the operation unit 3 and capable of being moved by a piston-cylinder device 10, as indicated by the arrow 11 in the figure.

The operations unit 3 includes a hydraulic unit 12 intended for maneuvering the abrasive belt, as explained in more detail below. The operations unit 3 also includes an assembly for removing grinding dust by suction, a compressed-air unit for controlling the grinding assembly, and optionally devices for supplying cooling air to the abrasive belt, this unit not being shown in detail in the drawings.

In the case of the illustrated embodiment, the operations unit is mounted on a carriage provided with wheels 13 (shown in broken lines) which run on rails 14. In accordance with one preferred embodiment, the grinding assembly is used for grinding stock advanced on a roller bed from a rolling mill or like plant, wherewith the carriage and the stock carried thereby are moved stepwise, such as to enable the carriage/stock to be moved one step in the opposite direction. In this respect, it is appropriate to grind the stock with an overlap of, e.g. 20% of the preceding ground area.

Figure 2:
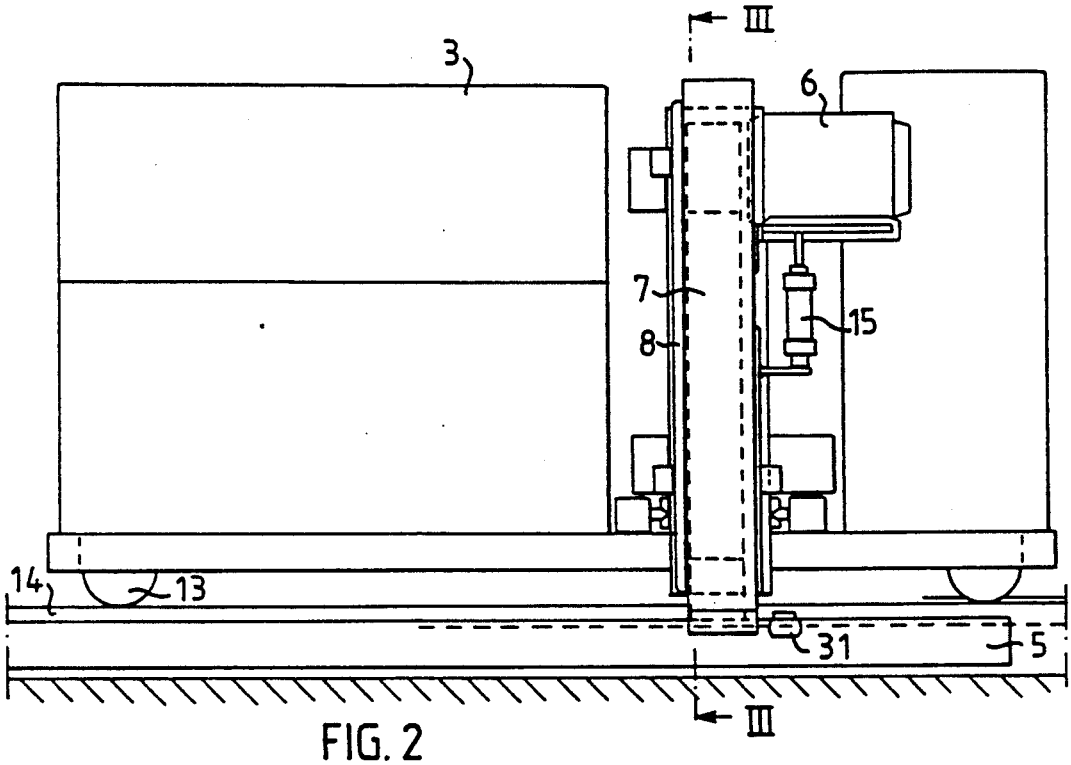
FIG. 2 is a sideview of the apparatus shown in FIG. 1.

FIG. 2 is a sideview of the apparatus shown in FIG. 1, adapted for grinding stock in a transverse direction. FIG. 2 illustrates the arrangement of the drive motor 6 on the grinding assembly, with an auxiliary piston-cylinder device 15 for adjusting belt tension and producing driving contact with the endless abrasive belt 7, and to enable belt-changes to be made, etc.

Figure 3:
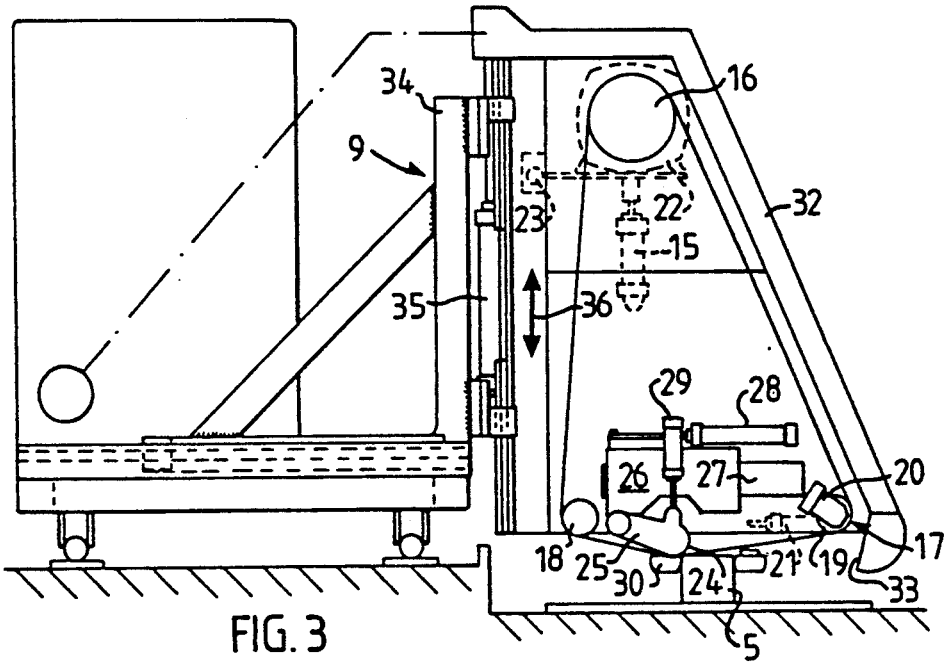
FIG. 3 is an end view of the apparatus shown in FIG. 1, with the grinding assembly shown in cross-section taken on the line III—III in FIG. 2.

FIG. 3 is a cross-sectional view of the grinding assembly showing the essential components for carrying out the inventive process. The endless abrasive belt 7 runs over a drive roller 16 mounted on the output shaft of the drive motor 6, and over belt guides 17 and 18. At least one of the belt guides, 17, is configured to counteract forces which act transversely to the belt and is provided with a roller 19 having a pivotal wheel holder 20 actuable by hydraulic piston-cylinder devices 21, of which only one such device is shown in the figure. Belt tension is controlled by means of the hydraulic piston-cylinder device 15, which acts on a plate 22 carrying the motor 6 and which has on one edge thereof a hinge device 23 for pivotally connecting the plate to the frame part 9.

The endless abrasive belt 7 is also acted upon by a contact device, which in the illustrated embodiment has the form of a contact roller 24 of small diameter. The contact roller 24 is pivotally hung from an arm 25 on a holder 26 which is mounted on a slide 27 for horizontal movement in the grinding assembly. The holder 26 is moved reciprocatingly by means of a hydraulic piston-cylinder device 28, such as to cause the contact roller 24 to oscillate. The contact roller 24 is also activated by a pneumatic piston-cylinder device 29, which can be loaded with fluid pressure for controlling the grinding pressure.

The grinding assembly also includes guide rollers 30, 31, which are preferably water-cooled and which can be used for guiding the grinding assembly and stock 5 respectively during a grinding operation. The belt casing includes a suction passage 32 with a suction orifice 33 located adjacent the up-stream-end of the belt, for the purpose of removing chips and dust by suction. This passage is connected to a fan provided in the operations unit by means of a hose not shown.

The frame structure 9 may, of course, be configured in several alternative manners and in the case of the illustrated embodiment comprises a column 34 on which the grinding assembly can be moved by means of a piston-cylinder device 35, as indicated by the arrow 36 in FIG. 3.

The apparatus and grinding assembly illustrated in FIG. 4 are adapted for grinding the square-section stock in the direction of its longitudinal axis, although in other respects the apparatus corresponds with the apparatus illustrated in FIGS. 1-3.

The apparatus operates in the following manner. The abrasive belt is adjusted to the correct belt tension by means of the piston-cylinder device 15, which acts on the plate 22 on which the drive motor 6 with drive roller 16 is mounted. The desired grinding pressure is applied on the contact roller 24, through the piston-cylinder device 29, and the contact roller is caused to oscillate by the piston-cylinder device 28. The length of this oscillating stroke is adapted so that the roller will pass over the edges of the square-section stock and can thereby be caused to grind over at least half the radius. In the case of a square-section stock, complete grinding can be effected by using four grinding assemblies according to the invention, arranged one after the other as seen in the direction of movement of the stock.

As before mentioned, the contact roller 24 has a small diameter and is caused to oscillate as rapidly as possible, which together with the fact that the abrasive belt rotates at high speed, means that the belt will not melt or be burned-up, despite the fact that the stock is red hot.

In the case of the illustrated embodiment, only one contact roller is used. According to a preferred embodiment of the apparatus, however, two or more contact rollers are used, since this will enable the oscillating rate to be increased, by reducing the length of oscillating stroke to a value slightly greater than the pitch between the contact rollers. In the case of stock of small dimensions, for instance up to 150 mm, there are suitably used two contact rollers, whereas in the case of stock of larger dimensions three or more contact rollers may be used, these rollers being mounted on a common boggie.

According to one alternative embodiment, the contact rollers are replaced with a pressure plate 40, which acts on the abrasive belt via an air cushion 42. The air cushion is effective in efficiently cooling the belt. By combining the pressure plate with contact rollers arranged on opposite sides of the plate, the planar surface of the stock facing the abrasive belt and at least half of the curvature of the arcuate edges of the stock can be ground at one and the same time, in the same advantageous manner. An arrangement is also conceivable in which the pressure plate oscillates and the contact rollers remain stationary in relation to the corner edges of the stock, in which case the rollers must be water-cooled. In this case, the pressure plate can be made exchangeable, so as to enable the apparatus to be adapted to stock of varying dimensions.

Furthermore, the grinding assembly may be mounted on planet wheels, so as to enable the assembly to be rotated around the whole of the stock, therewith enabling all four sides of the square-section stock to be ground simultaneously.

The invention is not restricted to the grinding of square-section stock, however, but can also be used to grind round stock and also for grinding so-called slabs, i.e. wider stock. When the described apparatus is used to grind round stock, there is preferably used two mutually opposing grinding assemblies, each of which grinds a respective half of the stock and each of which includes one or more oscillating contact rollers. Four grinding assemblies can also be arranged sequentially, and in the case of round stock two mutually opposing assemblies can be used to grind the stock, whereas the remaining two assemblies are switched-off. In order to increase capacity, the grinding assembly may be stationarily arranged and the stock caused to pass said assemblies, such that each assembly will machine a respective part of the stock surface.

When the stock is ground transversely of its longitudinal axis, in accordance with one embodiment of the invention, the influence of the fluid pressure on the contact device is utilized so that the stock surface which faces the abrasive belt is ground together with at least half the arc of the curved edges of said surface, thereby enabling the side surfaces and edge surface of said stock to be machined at one and the same moment in time and with one and the same piece of equipment.

It will be understood that the invention can be applied to, e.g. copper stock and cast-iron products, continuously cast stock, etc., in addition to steel and steel-alloy stock.

The apparatus for carrying out the inventive method can be modified in various ways without departing from the concept of the invention. For instance, the grinding assembly may be mounted for rotation through an angle of 90°, so as that the stock can be ground transversely to its longitudinal axis or in the direction of its longitudinal axis. The optionally water-cooled stock guiding rollers 30, 31 may be used to guide the grinding assembly in dependence of the stock, so as to bring the stock into engagement with the abrasive belt or to allow the stock to pass by freely, as the need may be.

Thus, the present invention is effective in preventing the occurrence of not-readily worked oxide layers and/or scale, by grinding away such layers and scale while they are still in a readily worked state. This means that grinding is effected while the stock arriving from a hot-working process is still red hot, i.e. as a temperature which lies above about 700° C. Thus, in the case of steel work is carried out at temperature above the Curie point.

A brief account is given below of tests carried out while applying the concept of the present invention.

Test grinding was carried out on hot square-section stock in accordance with the invention, with the stock lying on a roller bed immediately after being rolled. The belt dimension was 50×1500 mm, the belt speed about 40 m/s and there was used a rubber, serrated contact roller having a hardness of 70 Durometer. Grinding was carried out along the stock and transversely to the rounded edge of the stock. The following results were obtained:

1. Grinding with abrasive belt Slipnaxos×898 No. 36 (totally plastic zircon-corundum cotton fabric No. 36): The belt cut very lightly with white sparks, as when grinding lead. Results in a very coarse surface. The same belt scarcely had any grinding effect at all on stock which was cold. The belt had difficultly in penetrating the scale and produced dark-red sparks. Surface measurements using Bruel & Kjaer, type 6120, gave Ra 3–5 μm on hot ground surface, 1–1.5 μm on a cold ground surface. The surface values correspond to grindability, wherewith a coarse surface corresponds to a readily ground surface.

2. Grinding with an abrasive belt Slipnaxos×998 No. 60 (totally plastic zircon-corundum polyester fabric No. 60): Ground equally as well as No. 36, equally as white sparks. The surface was much finer. The belt endured grinding of the rounded edge and no sign of the polyester fabric melting was observed.

3. Grinding with an abrasive belt Slipnaxos×808 No. 50 (totally plastic corundum cotton fabric No. 50): This belt gave a much poorer grinding result than the two zircon- corundum belt and produced yellow sparks. The surface was much finer than the surface obtained in the two preceding tests.

Conclusions drawn from the tests: Despite temperatures of immediately below 1000° C., the only problem created by the heat radiating from the stock was that experienced by the operator. This problem was easily alleviated, by providing an appropriate screen. The machine, abrasive belt and contact rollers were not influenced by the heat. Belt economy is good, since the material is very easily ground at these temperatures.

I claim:

1. A method for treating surface faults and impurities on metal stock which has been subjected to hot working, comprising grinding said hot metal stock by applying an endless abrasive belt to said hot metal stock from said hot working while said hot metal stock remains at a temperature of between about 500° and 1500° C., and applying the desired grinding pressure to said hot metal stock during said grinding by means of a contact device in which the pressure applied by said contact device is created by a fluid, whereby said contact device maintains floating contact with said hot metal stock during said grinding.

2. The method of claim 1 wherein said hot metal stock remains at a temperature of between about 700° and 1200° C.

3. The method of claim 2 wherein said hot metal stock remains at a temperature of between about 800° and 1100° C.

4. The method of claim 1 wherein said endless abrasive belt comprises a backing material coated with abrasive particles.

5. The method of claim 4 wherein said backing material is selected from the group consisting of polyester and cotton.

6. The method of claim 4 wherein said abrasive particles are selected from the group consisting of zircon-corundum and corundum.

7. The method of claim 6 wherein said abrasive particles have a particle size in the range of between about 12 and 100 mesh.

8. The method of claim 7 wherein said abrasive particles have a particle size in the range of between about 20 and 50 mesh.

9. The method of claim 8 wherein said abrasive particles have a particle size in the range of between about 24 and 50 mesh.

10. The method of claim 1 wherein said grinding comprises applying said endless abrasive belt to said hot metal stock in said endless abrasive belt travelling at a speed of between about 10 and 50 m/s.

11. The method of claim 10 wherein said grinding comprises applying said endless abrasive belt to said hot metal stock with said endless abrasive belt travelling at a speed of between about 15 and 40 m/s.

12. The method of claim 11 wherein said grinding comprises applying said endless abrasive belt to said hot metal stock with said endless abrasive belt travelling at a speed of between about 20 and 35 m/s.

13. The method of claim 1 wherein said pressure applied by said contact device is created by a piston-cylinder device.

14. The method of claim 1 wherein said hot metal stock extends longitudinally, and said grinding of said hot metal stock is conducted transversely to said longitudinal direction.

15. The method of claim 14 wherein said hot metal stock comprises a plurality of longitudinally extending arcuate edges, and wherein said grinding of said hot metal stock comprises bending said endless abrasive belt around at least half of the curvature of said longitudinal arcuate edges of said hot metal stock.

16. The method of claim 1, wherein said contact device comprises a pressure plate, and said step of applying the desired grinding pressure to said hot metal stock comprises forming an air cushion between said pressure plate and said endless abrasive belt and maintaining said air cushion at a predetermined pressure to be uniformly applied to said endless abrasive belt.

17. The method of claim 16 wherein said hot metal stock remains at a temperature of between about 700 and 1200° C.

18. The method of claim 16 wherein said hot metal stock remains at a temperature of between about 800° and 1100° C.

19. The method of claim 16 wherein said endless abrasive belt comprises a backing material coated with abrasive particles.

20. The method of claim 19 wherein said backing material is selected from the group consisting of polyester and cotton.

21. The method of claim 19 wherein said abrasive particles are selected from the group consisting of zircon-corundum and corundum.

22. The method of claim 21 wherein said abrasive particles have a particle size in the range of between about 12 and 100 mesh.

23. The method of claim 21 wherein said abrasive particles have a particle size in the range of between about 20 and 60 mesh.

24. The method of claim 21 wherein said abrasive particles have a particle size in the range of between about 24 and 50 mesh.

25. The method of claim 16 wherein said grinding comprises applying said endless abrasive belt to said hot metal stock with said endless abrasive belt travelling at a speed of between about 10 and 50 m/s.

26. The method of claim 16 wherein said grinding comprises applying said endless abrasive belt to said hot metal stock with said endless abrasive belt travelling at a speed of between about 15 and 40 m/s.

27. The method of claim 16 wherein said grinding comprises applying said endless abrasive belt to said hot metal stock with said endless abrasive belt travelling at a speed of between about 20 and 35 m/s.

28. The method of claim 16 wherein said hot metal stock extends longitudinally, and said grinding of said hot metal stock is conducted transversely to said longitudinal direction.

29. The method of claim 28 wherein said hot metal stock comprises a plurality of longitudinally extending arcuate edges, and wherein said grinding of said hot metal stock includes the steps of bending said endless abrasive belt around at least half of the curvature of said longitudinal arcuate edges of said hot metal stock.

30. Apparatus for treating surface faults and impurities on metal stock which has been subjected to hot working comprising grinding means for grinding said hot metal stock, said grinding means including an endless abrasive belt for grinding said hot metal stock while said hot metal stock from said hot working remains at a temperature of between about 500° and 1500° C., and contact means for applying the desired grinding pressure to said hot metal stock during said grinding, said contact means including a pressure plate disposed a predetermined distance above said endless abrasive belt and air cushion means formed between said pressure plate and said endless abrasive belt for exerting the desired grinding pressure upon said endless abrasive belt which in turn applies said grinding pressure to said hot metal stock during said grinding.

31. The apparatus of claim 30 wherein said contact means further comprises a pair of pressure rollers disposed on opposite sides of said pressure plate.

* * * * *

UNITED STATES PATENT AND TRADEMARK OFFICE

CERTIFICATE OF CORRECTION

PATENT NO. : 5,193,317

DATED : March 16, 1993

INVENTOR(S) : Nordquist et al.

It is certified that error appears in the above-identified patent and that said Letters Patent is hereby corrected as shown below:

Column 3, line 35, "jointbelt" should read --joint belt--.
Column 8, line 57, after "fluid," insert --said contact device comprising oscillating means for rapidly oscillating on said endless abrasive belt and applying a predetermined pressure thereto--.
Column 9, line 12, "50" should read --60--.
Column 9, delete lines 42-48 and insert --16. A method for treating surface faults and impurities on metal stock which has been subjected to hot working, comprising grinding said hot metal stock by applying an endless abrasive belt to said hot metal stock from said hot working while said hot metal stock remains at a temperature of between about 500° and 1500°C, and applying the desired grinding pressure to said hot metal stock during said grinding by means of a contact device in which the pressure applied by said contact device is created by a fluid whereby said contact device maintains floating contact with said hot metal stock during said grinding, wherein said contact device comprises a pressure plate, and said step of applying the desired grinding pressure to said hot metal stock comprises forming an air cushion between said pressure plate and said endless abrasive belt and

UNITED STATES PATENT AND TRADEMARK OFFICE

CERTIFICATE OF CORRECTION

PATENT NO. : 5,193,317

DATED : March 16, 1993

INVENTOR(S) : Nordquist, et al

It is certified that error appears in the above-indentified patent and that said Letters Patent is hereby corrected as shown below:

maintaining said air cushion at a predetermined pressure to be uniformly applied to said endless abrasive belt.--

Signed and Sealed this

Seventh Day of December, 1993

*Attest:*

Bruce Lehman

BRUCE LEHMAN

*Attesting Officer*

*Commissioner of Patents and Trademarks*